US005199468A

United States Patent [19]

Aarts et al.

[11] Patent Number: 5,199,468

[45] Date of Patent: Apr. 6, 1993

[54] WEFT YARN CLEARING DEVICE

[75] Inventors: Hubertus H. Aarts, Deurne; Antonius J. M. Hamer, Eindhoven, both of Netherlands

[73] Assignee: Sulzer Brothers Limited, Winterthur, Switzerland

[21] Appl. No.: 702,847

[22] Filed: May 20, 1991

[30] Foreign Application Priority Data

Jun. 21, 1990 [CH] Switzerland ..... 2075/90

[51] Int. Cl.[5] ..... D03D 45/50; D03D 47/34

[52] U.S. Cl. ..... 139/450; 139/439; 139/116.2

[58] Field of Search ..... 139/450, 116.2, 438, 139/439, 453, 351, 353, 291 C, 302, 303

[56] References Cited

U.S. PATENT DOCUMENTS 4,296,783 10/1981 Ichimatsu ..... 139/302
4,664,157 5/1987 Shin .
4,749,006 1/1988 Miyamoto ..... 139/116.2
4,890,650 1/1990 Mitsuya .
4,899,788 2/1990 Aarts ..... 139/116.2
4,969,489 11/1990 Tanaka ..... 139/450

FOREIGN PATENT DOCUMENTS 0171057 2/1986 European Pat. Off. .
0236597 9/1987 European Pat. Off. .
0332257 9/1989 European Pat. Off. .
2248353 5/1975 France .
2527655 12/1983 France .
2537168 6/1984 France .

*Primary Examiner*—Andrew M. Falik
*Attorney, Agent, or Firm*—Kenyon & Kenyon

[57] ABSTRACT

The weft yarn clearing device is of use for an automatic method of clearing weft breakages in projectile looms. In the event of the yarn breakage in the shed, the weft yarn is engaged in the shed by at least one gripper element, then supplied to the inlet of an extractor and placed between the rollers of a pair of draw-off rollers. The rollers draw the weft yarn out of the shed and the weft yarn is simultaneously supplied by the extractor to a collecting receptacle. The clearing device can also be used for a yarn breakage before the shed.

11 Claims, 3 Drawing Sheets

WEFT YARN CLEARING DEVICE

This invention relates to a weft yarn clearing device for a loom.

Heretofore, looms have been constructed with various picking devices for the picking of a weft yarn into a shed of warp yarns. In the event of a weft-yarn breakage, the looms must be stopped, the broken weft yarn removed, the picking mechanism prepared with fresh yarn and the loom restored. In order, to reduce downtime due to such weft breakages, the looms have been provided with various types of automatic devices to render manual intervention by a loom operative unnecessary. In this respect, several different types of devices have been known for automatically removing yarn residues in the event of a weft-yarn breakage as well as devices for drawing a weft yarn into a loom in which a yarn is supplied from a bobin to a picking element. Such devices are disclosed, for example, in European Patent Application 0 365 472 for use in air jet looms. However, these devices may also be adapted for use in projectile looms.

European Patent Application 0 290 383 describes a mechanical aid which is effective in removing a broken weft yarn from a shed against the warp yarn friction and to provide interim storage of the yarn before the yarn is removed by means of a suction tube.

Devices for removing a broken weft yarn from within a shed are also described in U.S. Pat. Nos. 4,890,650 and 4,664,157; French Patents 2,537,168; 2,527,655 and 2,248,353 as well as European Patent Applications 0 332 257 and 0 236 597. However, such mechanisms have been rather cumbersome and are time consuming in operation and are generally limited to removing broken yarn ends from a weft yarn which has broken only within a shed.

It is an object of the invention to provide a weft yarn clearing device which does not require interim storage for removal purposes.

It is another object of the invention to provide a reliable weft yarn clearing device which does not require an inordinate time to remove a broken weft yarn from a shed of warp yarns.

It is another object of the invention to provide a relatively simple weft yarn clearing device for clearing weft yarn breakages in a loom.

Figure 1:
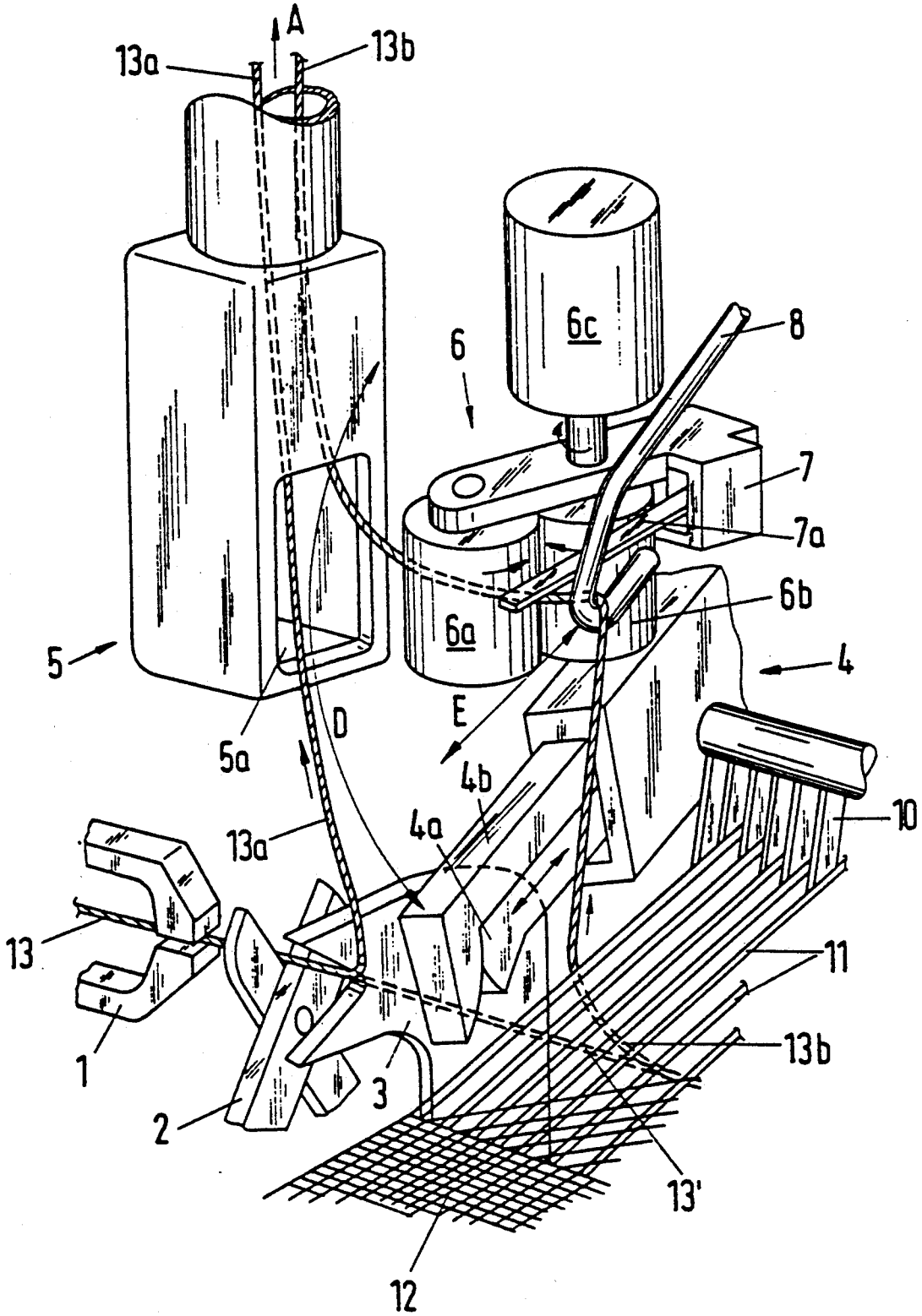
Figure 1A:
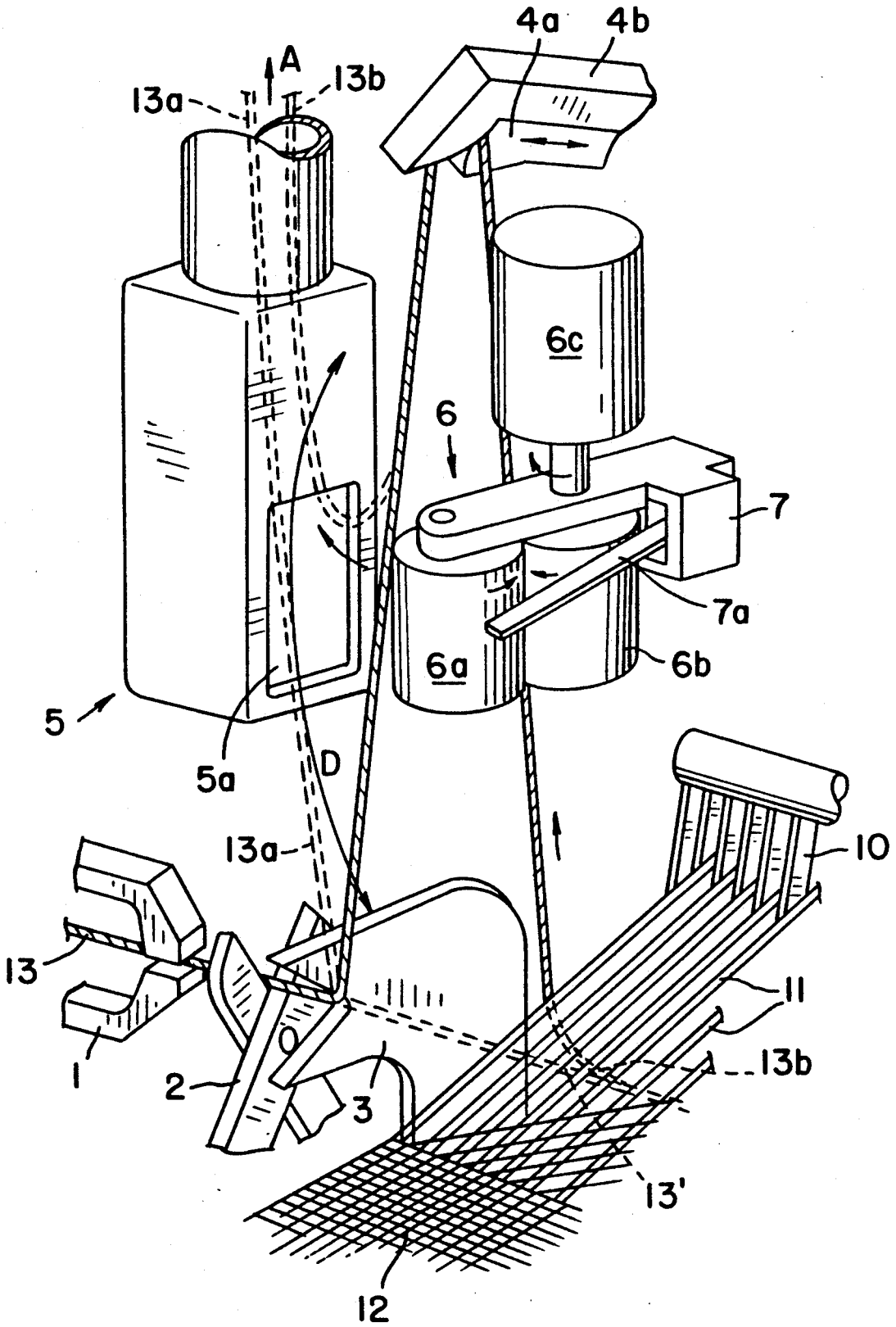

Briefly, as shown in FIG. 1*a*, the invention provides a weft yarn clearing device for a loom which includes an extractor having an inlet for entry of a weft yarn, a pair of draw-off rollers and at least one gripping element which is movable from a first position to grip a weft yarn extending from a shed of warp yarns to a release position adjacent the extractor inlet in order to deliver the gripped weft yarn thereto. In addition, the gripper element serves to position the weft yarn between the draw-off rollers for withdrawing of the weft yarn from the shed.

The extractor is in the form of a pneumatic extractor for drawing the delivered weft yarn therethrough. The draw-off rollers are driven in any suitable manner so as to pull the broken weft yarn from a shed and to deliver the same to the extractor.

In another embodiment of the present invention, the clearing device also has a movable hook for guiding the weft yarn which extends from the gripping element into the shed between the draw-off rollers. In addition, a force sensor is provided on the hook for sensing the tension in the guided weft yarn. Should the sensed tension be relatively large, for example, indicative of the broken yarn being caught within the shed, the clearing device can be deactivated so that the weft yarn can be otherwise removed.

The weft yarn clearing device may be used on both sides of a shed for the removal of broken weft yarns from within the shed, particularly where the yarn breaks within the shed.

In another embodiment, the weft yarn clearing device provided on the brake side of the shed employs a pivotally mounted pneumatic extractor, a gripper element pivotally mounted on the extractor for engaging with a broken weft yarn and a pair of draw-off rollers for receiving a broken weft yarn therebetween for delivery to the pivotally mounted extractor.

The invention also provides a method of clearing a broken weft yarn from a shed of warp yarns in a loom. In accordance with the method, a weft yarn which has broken within a shed is first gripped at a position outside the shed and directed into a pneumatic extractor. In addition, an intermediate portion of a gripped weft yarn is placed between a pair of rotating draw-off rollers for drawing of the weft yarn from within the shed while directing the weft yarn into the extractor. Further, the weft yarn is severed at a position upstream of the extractor so that the unwanted length of weft yarn can be completely removed through the extractor.

Figure 2:
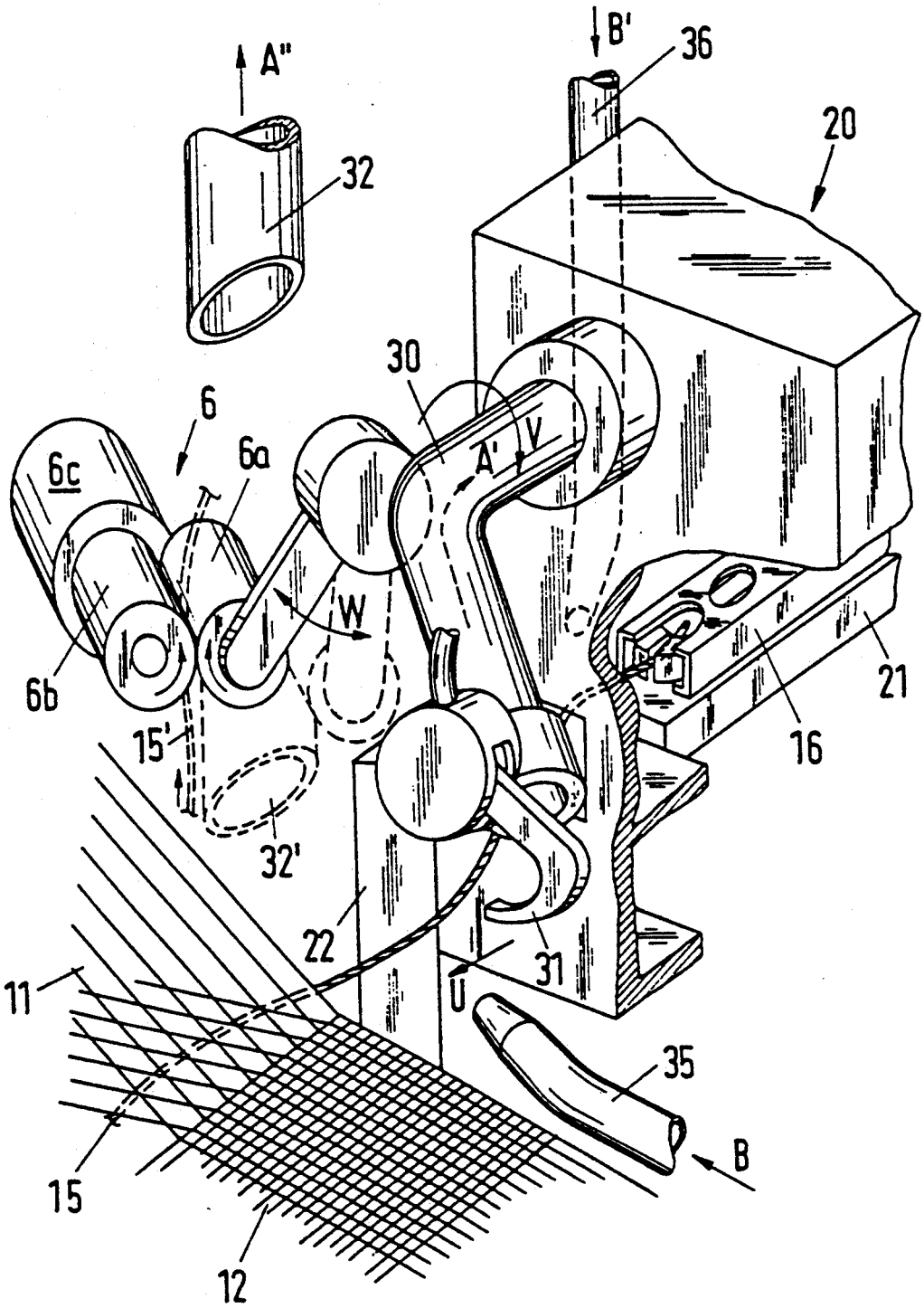

These and other objects and advantages of the invention will become more apparent from the following detailed description taken in conjunction with the accompanying drawings wherein:

FIG. 1 illustrates a perspective view of a weft yarn clearing device constructed in accordance with the invention and within a loom;

FIG. 1*a* illustrates a perspective view of a weft yarn clearing device constructed in accordance with the invention wherein the gripper element is in a release position; and FIG. 2 illustrates a perspective view of a modified weft yarn clearing device on a catching side of a loom.

Referring to FIGS. 1 and 1*a*, the loom is of the projectile type and includes a clamp 1 of a yarn giver, the same being in a forwards position; shears 2 in a severance position; a centering vane 3 adapted to pivot rearwardly; a weft yarn clearing device including a gripper element 4, a pneumatic suction extractor 5, a pair 6 of draw-off rollers 6*a*, 6*b*, and a yarn monitor 7; a reed 10, Warp yarns 11 forming a shed; and cloth 12.

The yarn giver with the clamp 1 is part of a picking mechanism (not shown) in which a projectile is prepared for picking and which is preceded by weft accumulators (not shown) and a yarn-conveying injector nozzle (not shown) disposed between each such accumulator and the picking mechanism.

As illustrated, the gripper element 4 has a pair of clamping elements 4*a*, 4*b* wherein one clamping element 4*a* is reciprocally mounted as indicated by the double-headed arrow. In addition, the gripper element 4 is pivotally mounted as indicated by the double-headed arrow D so as to move from a gripping position adjacent the shed to grip a weft yarn extending therefrom to a release position adjacent the extractor 5 in order to deliver the gripped weft yarn thereto.

The extractor 5 has an inlet 5*a* which is sized to receive the weft yarn delivered via the gripper element 4.

The pair 6 of draw-off rollers 6a, 6b is mounted adjacent the extractor 5 and in fixed relation thereto. As shown, a motor 6c is used to drive the rollers 6a, 6b.

The yarn monitor 7 is mounted on a common frame with the pair of rollers 6a, 6b in order to sense the presence of a yarn introduced between the rollers 6a, 6b as described below.

In the embodiment of the present invention shown in FIG. 1, a movable hook 8 is also provided in the weft yarn clearing device for guiding a weft yarn, a portion of which extends from the gripper element 4 into the shed, between the rollers 6a, 6b as described below.

In the event of a weft yarn breakage in the shed, the device for clearing the yarn breakage operates as follows: The gripper element 4 engages by way of the two clamping elements 4a, 4b, the broken weft yarn 13 between the vane 3 and the shed. Thereafter, the yarn 13 is drawn upwards by the gripper element 4, as indicated by a double arrow D, the drawing of yarn from the shed and from the weft accumulator (not shown) leading to the formation of a loop. One side of the loop—i.e., the yarn piece 13a—is moved before the inlet 5a of the extractor 5. When air is sucked in, in the direction indicated by the arrow A, the yarn piece 13a is drawn in a loop into the extractor 5. Advantageously, the injector nozzle previously referred to assists in the drawing of the yarn 13a off the weft accumulator. As shown in FIG. 1, the other side of the weft yarn loop—i.e. the yarn piece 13b—may then be introduced by means of the hook 8 between the two rollers 6a, 6b of the roller pair 6. The yarn monitor 7 acting, for example, by way of a sensing finger 7a or the like shown in FIG. 1, records the presence of the introduced yarn piece 13b between the rollers 6a, 6b .

The gripper element 4 can be embodied in a variety of ways, for example, as a yarn clamp as described in EP-A-0 290 383. A manipulator devised as a motion automat actuates the yarn clamp, which has an actuating motor for a pivoting clamping jaw. The hook 8, which can of course be embodied differently, is also actuated by means of a motion automat (not shown) when the yarn piece 13 is introduced between the draw-off rollers 6a, 6b as indicated by a double arrow E. Advantageously, a force sensor (not shown) for monitoring the tension of the yarn 13b is disposed on the hook 8 or its manipulator. The broken weft yarn may stick in the warp yarns, with the risk of a warp yarn breakage. The force sensor mentioned helps to provide overload protection which responds to excessive yarn tension by interrupting the weft breakage clearance so that the yarn clearance can then be continued manually.

In the absence of any disturbance, the extractor 5 in co-operation with the roller pair 6 and possibly with the injector nozzle (not shown) at the output of the weft accumulator (not shown) completely removes the broken yarn piece 13b from the shed. The conclusion of this step can be initiated by means of the yarn monitor 7 which records the exit of the yarn end. Weft breakage clearance on the input side of the shed terminates by the weft yarn 13 being retained by the yarn giver clamp 1, the yarn 13 being severed by the shears 2 and the severed yarn piece 13a being conveyed by the extractor 5 to a collecting box.

The other piece of broken yarn which has been conveyed onwards by the projectile (not shown) can be removed correspondingly on the exit side of the shed by means of a device identical to the device on the entry side of the shed.

In the event of a weft yarn breakage between the weft accumulator (not shown) and the shed, the picked weft yarn can be woven into the cloth. All that is necessary in this case is further threading-up in the picking mechanism. This can be performed as follows: The injector nozzle (not shown) between the accumulator and the picking nozzle (not shown) draws a piece of weft yarn 13 off the accumulator and blows the yarn over the vane 3 and the warp yarns 11. This piece of yarn can be engaged by the gripper element 4 and first placed in the throat of the vane 3. Thereafter, as at the start of the weft yarn clearance hereinbefore described, the weft yarn can be drawn by the gripper element 4 to the extractor 5 and intaken thereby. After the gripper element 4 has released the yarn, the known terminal phase of weft breakage clearance proceeds. Weaving can restart after the surplus yarn piece 13a has been severed and extracted.

Referring to FIG. 2 wherein like reference characters indicate like parts as above, the weft yarn clearing device on the catching side of the loom may be constructed in an alternative manner for removing a broken weft yarn 15 on the exit side of the shed. As illustrated, the loom has a catching brake 20 for a projectile 16. This brake 20 includes a bottom brake shoe 21, a projectile ejection duct 22 as well as other components which are not shown such as a projectile retractor, projectile opener, ejector and top-brake shoe.

The weft yarn clearing device employs a pivotally mounted pneumatic extractor 30 which is pivotal as indicated by the arrow V and a gripper element 31 pivotally mounted on the extractor 30 at the inlet end. In addition, the weft clearing device includes a pair of draw-off rollers 6a, 6b which are driven by a common motor 6c . As indicated, one of the draw-off rollers 6a is pivotally mounted as indicated by the double-headed arrow W so as to be moved away from the other roller 6b.

In addition, the weft yarn clearing device employs a suction duct 32 and a pair of blowing nozzles 35, 36.

In the event of the weft yarn 15 breaking near the exit side of the shed, the weft yarn 15 may be torn out of the shed and hurled into the brake 20. To this end, one blowing nozzle 36 is disposed laterally beside the brake 20 and is effective to blow the yarn 15 out back into the space between the shed and the brake 20. The yarn 15 can then be engaged in the latter space by the extractor 30 pivoting, the same being disposed, for example, on the brake housing, and by actuation of the gripper element 31 as indicated by an arrow U. By further pivoting, indicated by the arrow V, the piece of yarn hanging down near the extractor 31 on the shed side can be introduced between the draw-off rollers 6a, 6b . The roller pair 6 must previously be opened, for example, by the roller 6a pivoting away as indicated by the double arrow W in FIG. 2.

To assist the gripper element 31 to catch the weft yarn 15, air is sucked in by way of the extractor 30 as indicated by an arrow A and the air blowing nozzle 35 produces a bunched air flow which produces a suction effect on the weft yarn 15.

After the weft yarn 15' has been placed between the draw-off rollers 6a, 6b and after the projectile clamp has opened, the yarn can be supplied by the extractor 30 to a collecting box or receptacle (not shown). Alternatively, the weft yarn 15 can be presented by means of the gripper element 31 to the suction duct 32 which is disposed above the roller pair 6 and by way of which the yarn is extracted by suction as indicated by an arrow A.

In the event of a weft yarn breakage just a few centimeters behind the projectile 16, the roller pair 6 is not needed. After the projectile clamp has opened, the short yarn piece 15 is blown directly by the nozzle 35, for example, into the downwardly pivoted extractor 30 or into the extraction duct 32 and removed to the collecting box. Advantageously, the suction duct 32 is flexible in the second example and its inlet can be moved to a lower position 32'. The nozzle 35 can then provide a smaller propelling stream in order to remove the yarn piece 15.

As previously described, the procedures for clearing a yarn breakage vary in dependence upon where the break occurs —i.e., before the shed, in the middle of the shed or near the edge of the shed. To make it unnecessary to resort to diagnostic facilities for locating the break, a programmed sequence of steps not calling for prior knowledge of the position of the break is provided. Every possible way of clearing a weft breakage is used step by step. Various submethods for actuation of the devices are carried out completely even though the appropriate step for the yarn is not yet found. For example, when the weft yarn breaks near the projectile of the device shown in FIG. 2, the procedure for introducing the yarn 15 into the draw-off roller pair 6 is carried out even though yarn length is too short. Other submethods can be interrupted prematurely when a sensor records —for example, when the yarn monitor 7 does not produce an expected signal—that the submethod being used is unsuitable. After the interruption or performance of an unsuitable submethod, operations continue in the next submethod of the programmed sequence until either the weft yarn breakage is finally cleared satisfactorily or the loom operative is warned that manual intervention is necessary.

The invention thus provides a relatively simple technique for clearing weft yarn breakages from a loom. Further, the invention provides a weft yarn clearing device of relatively simple construction which can be used on either side of a shed for clearing a weft yarn break.

What is claimed is:

1. A weft yarn clearing device for a loom comprising
an extractor having an inlet for entry of a weft yarn into said extractor;
a pair of draw-off rollers; and
at least one gripper element movable from a first position to grip a weft yarn extending from a shed of warp yarns to a release position adjacent said extractor inlet to deliver a first portion of the gripped weft yarn to the extractor and to position a second portion of the weft yarn between said rollers for withdrawing of the weft yarn from the shed.

2. A weft yarn clearing device as set forth in claim 1 which further comprises a moveable hook for assisting in guiding a weft yarn extending from said gripper element into the shed to a position such that at least a portion of said weft yarn is located between said rollers.

3. A weft yarn clearing device as set forth in claim 2 which further comprises a force sensor on said hook for sensing the tension in a guided weft yarn.

4. A weft yarn clearing device as set forth in claim 2 wherein said extractor and said draw-off rollers are fixedly mounted.

5. A weft yarn clearing device as set forth in claim 1 wherein said extractor is pivotally mounted, the gripper element is pivotally mounted on said extractor and at least one of said rollers is mounted such that it is moveable away from the other of said rollers.

6. A weft yarn clearing device as set forth in claim 1 which further comprises a yarn monitoring device for sensing the presence of a weft yarn between said rollers.

7. A weft yarn clearing device as set forth in claim 1 which further comprises a shears for cutting a weft yarn extending to said extractor.

8. A weft yarn clearing device for a loom comprising
a pneumatic extractor having an inlet for entry of a weft yarn therethrough;
a pair of draw-off rollers;
a gripper element moveable from a first position to grip a weft yarn extending from a shed of warp yarns to a release position adjacent said extractor for drawing of the yarn therethrough; and
a moveable hook for assisting in guiding a weft yarn extending from said gripping element into the shed to a position such that at least a portion of said weft yarn is located between said rollers for drawing of the weft yarn from the shed.

9. In a loom, the combination comprising
a weft yarn clearing device on one side of a shed of warp yarns, said device including a pneumatic extractor, a pair of draw-off rollers, and a gripper element, said gripper element being moveable between a first position for gripping a broken weft yarn extending from the shed and a release position adjacent said extractor for delivering a first position of the weft yarn to said extractor and for positioning a second portion of the weft yarn between said rollers for withdrawing of the weft yarn from the shed;
a projectile-catching brake on an opposite side of the shed of warp yarns; and
a second weft yarn clearing device between the shed and said brake, said device including a pivotally mounted pneumatic extractor, a gripper element pivotally mounted on said pivotally mounted extractor and a pair of draw-off rollers for receiving a broken weft yarn therebetween for delivery to said pivotally mounted extractor.

10. A method of clearing a broken weft yarn from a shed of warp yarns in a loom comprising the steps of
gripping a weft yarn broken within a shed at a position outside the shed;
directing the gripped weft yarn into a pneumatic extractor for removal of the weft yarn;
placing an intermediate portion of the gripped weft yarn between a pair of rotating draw-off rollers for drawing the weft yarn from within the shed while directing the weft yarn into the extractor; and
severing the weft yarn at a position upstream of the extractor.

11. A method as set forth in claim 10 wherein said steps are performed in a programmed sequence.

* * * * *

UNITED STATES PATENT AND TRADEMARK OFFICE

CERTIFICATE OF CORRECTION

PATENT NO. : 5,199,468

DATED : April 6, 1993

INVENTOR(S) : Aarts et al.

It is certified that error appears in the above-identified patent and that said Letters Patent is hereby corrected as shown below:

Column 2, line 50, change "Warp" to --warp--;

Column 6, lines 38 & 39, change "position" to --portion--.

Signed and Sealed this

Seventh Day of June, 1994

*Attest:*

Bruce Lehman

BRUCE LEHMAN

*Attesting Officer*

*Commissioner of Patents and Trademarks*